US006310278B1

(12) United States Patent
Butler

(10) Patent No.: US 6,310,278 B1
(45) Date of Patent: Oct. 30, 2001

(54) DRUMSTICKS

(76) Inventor: Torry Butler, N6367 Hwy. E, Oconomowoc, WI (US) 53066

( * ) Notice: Subject to any disclaimer, the term of this patent is extended or adjusted under 35 U.S.C. 154(b) by 0 days.

(21) Appl. No.: 09/587,326

(22) Filed: Jun. 5, 2000

(51) Int. Cl.[7] ..... G10D 13/02
(52) U.S. Cl. ..... 84/422.4
(58) Field of Search ..... 84/422.4

(56) References Cited

U.S. PATENT DOCUMENTS

| | | | | |
|---|---|---|---|---|
| 1,953,619 | * | 4/1934 | Ludwig | 84/422.4 |
| 3,665,799 | * | 5/1972 | Hinger | 84/422.4 |
| 3,998,123 | * | 12/1976 | Hinger | 84/422.4 |
| 4,640,177 | | 2/1987 | Elliot, Jr. | 84/422 S |
| 4,702,143 | | 10/1987 | Brochstein | 84/422 S |
| 5,170,001 | | 12/1992 | Amendola | 84/422.4 |
| 5,260,506 | * | 11/1993 | Cappella | 84/422.4 |
| 5,341,716 | | 8/1994 | Donohoe | 84/422.4 |
| 5,400,685 | | 3/1995 | Capella | 84/422.4 |
| 5,447,088 | * | 9/1995 | Mester | 84/422.4 |
| 5,503,056 | * | 4/1996 | Evans | 84/422.4 |
| 5,728,958 | | 3/1998 | Vater | 84/422.4 |

* cited by examiner

*Primary Examiner*—Shih-Yung Hsieh
(74) *Attorney, Agent, or Firm*—Willis B. Swartwout, III

(57) ABSTRACT

An improved drumstick or percussion striking device wherein the device consists of an elongated member having a striking tip at one end a handle butt at the end remote from the tip and a protrusion or bump intermediate the tip and butt, thus spaced axially from each but more proximate to the tip than to the butt, thereby enabling the percussionist to strike the same object with both tip and protrusion or two objects one with tip and one with protrusion. The elongated member may be a unit or two individual parts solidly interconnected, one called the shaft portion and one called the handle portion. The tip and protrusion may be a part of the member or may be separate and frictionally engaged therewith. An axially disposed oval hand grip on the handle portion and structure for adding weights either to the joint between the two portions or at the butt end of the handle to weight the stick to the percussionists desire. The tip and bump produce as used by the percussionist a variety of sought after sounds.

3 Claims, 2 Drawing Sheets

DRUMSTICKS

BACKGROUND OF THE INVENTION

The present invention relates to drumsticks and more particularly to improved percussion drumsticks which are able to produce a unique sound desired by the percussionist.

The shape and length of drumsticks, as can be noted from a review of the prior art, is dependent on two factors. The first are the physical attributes of the percussionists hands and arms and the second is the sound which is desired to be obtained from the percussion instrument. Various shapes of tips of drumsticks have been shown and some patented in the past which have been designed to evoke an unusual or different sound from a drum or other percussion instruments. Brushes have been used for cymbals and a hard stick for triangles or bells all to this purpose. Some ingenuity is sometimes needed to combine utilities for the same drumstick so the percussionist does not have to change mallets or sticks excessively.

SUMMARY OF THE INVENTION

The present invention proposes to provide in a percussion stick, mallet or the like an elongated structure provided with a percussion tip at one end and a second striking surface axially removed from that end a short distance.

It is an object of the invention to provide in a device of the character above described an elongated stick or mallet having a percussion instrument surface or skin striking tip at one end, a handle portion at the end remote therefrom and a second striking surface intermediate the ends and more proximate to the tip than to the handle.

It is another object of the present invention to provide in a device of the character above described an elongated stick or mallet which is articulated in between the handle portion and the second striking surface.

It is yet another object of the present invention to provide in a device of the character above described an elongated stick or mallet, generally circular in cross-sectional dimension, articulated as above described and having a generally conical tip and oval second striking surface.

It is still another object of the present invention to provide in a device of the character above described an articulated union as above set fort or handle portion which is flexible or deformable relative to the remainder thereof.

Various other objects and advantages will become apparent as this description proceeds, as will various modifications or changes that may be made to the structure of the invention without departing from the spirit of the invention. These various modifications, changes, objects and advantages are intended to be covered by the scope of the appended claims.

DESCRIPTION OF THE PREFERRED EMBODIMENTS

Figure 1:
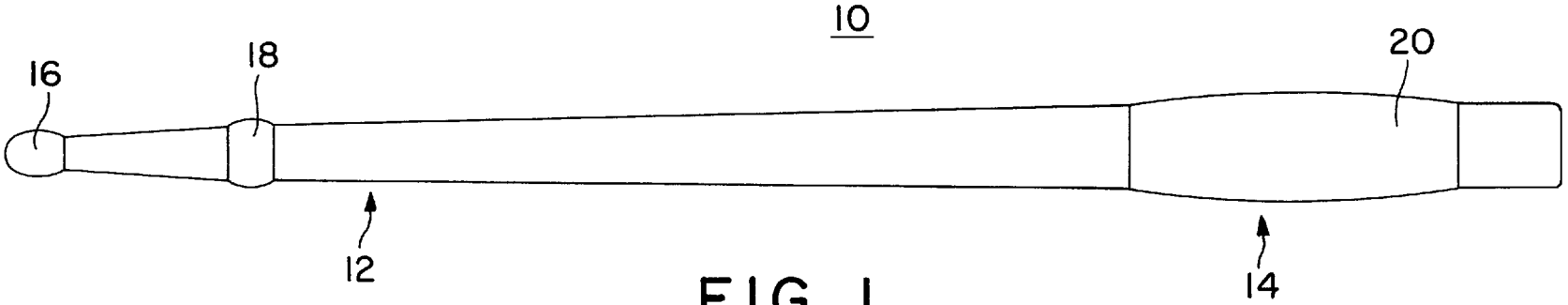
FIG. 1 is a horizontal plan view of one embodiment of the present invention.
Figure 2:
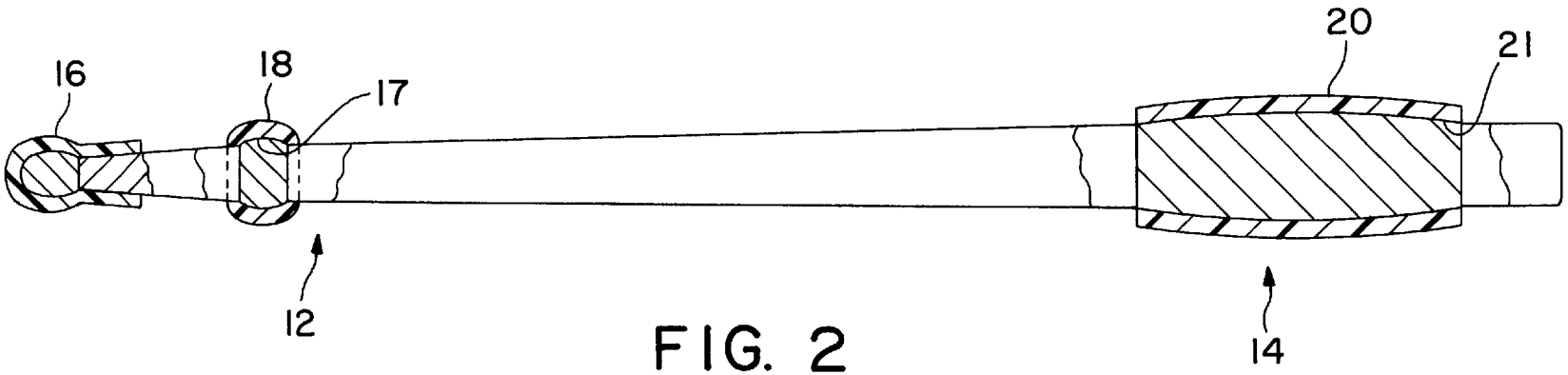
FIG. 2 is a view similar to FIG. 1 with portions broken away to show details of construction.

Referring now to the drawings and particularly to FIGS. 1 and 2 thereof there is shown and generally identified by the numeral 10, one embodiment of a preferred form of the improved drumstick. Drumstick 10 is Generally circular in cross-sectional dimension and is divided into two elongated portions called the shaft portion, generally identified by the numeral 12; and the handle portion, generally identified by the numeral 14.

At one end of shaft portion 12 is a tip 16 which is formed from "Nylon" or other material such as plastic, wood, rubber, graphite or the like. The tip is generally conical in overall shape and has a recess frictionally fitted snugly over the one end of the shaft portion 10 and is used for the purpose of striking the head of a drum, cymbal, or other percussion instrument to produce sound.

Spaced axially along shaft portion 10 from tip 16 is a striking protrusion or bump 18. Protrusion or bump 18 generally spherical in overall shape which may be cut from the stick material on a lathe or the Like, but which may also be of a similar material as the tip and molded separately with an axial aperture 17 therethrough shaped in cross-sectional dimension to frictionally slide over the external dimension of the shaft portion 10. The optimum axial spacing of the protrusion or bump 18 from tip 16 is 1 and 3/4 inches but this can vary without departing from the spirit of the invention and to suit the needs of the individual user. The purpose of a tip 16 and a protrusion or bump 18 is to enable the percussionist to use it for "riding" the high hat, for brighter, clearer, sharper sound or when the stick 10 is held in the proper position to enable the simultaneous striking of the same surface by both the tip 16 and the protrusion 18, producing a deeper and louder sound.

Handle portion 14 may just be a designated portion of the drumstick 10 remote from tip 16 of shaft portion 12 if the stick 10 is cut on a lathe or similarly produced but will contain a hand grip 20 axially spaced from tip 16 and protrusion 18 intermediate the end of shaft portion 12 proximate handle portion 14 and the end of handle portion 14 remote from shaft portion 12. Hand grip 20 is generally oval axially relative to handle portion 14. If not created in the making of the stick 10, handle grip 20 may be made from any of the materials from which the tip 16 is made and adapted by having a longitudinal aperture 21 therethrough which is shaped in cross-sectional dimension the same as the exterior cross-sectional dimension of handle portion 14 thereby making it possible to fit it frictionally around and on handle portion 14 at a desirable location.

Figure 3:
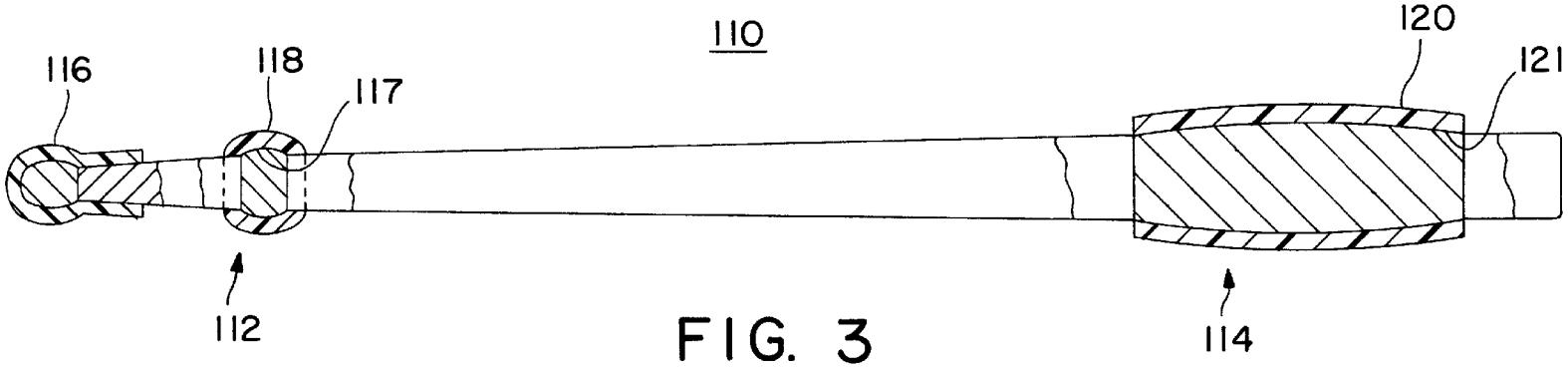
FIG. 3 is a horizontal plan view of a second embodiment of the present invention.
Figure 4:
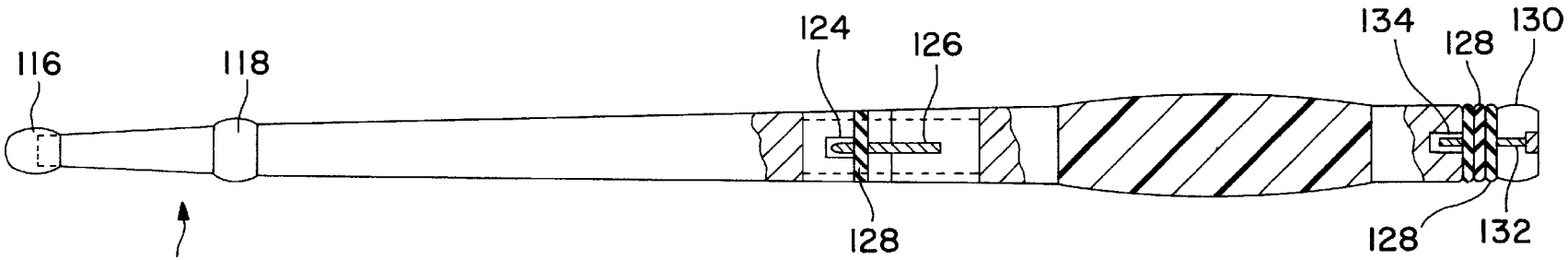
FIG. 4 is a view similar to FIG. 3 with portions broken away to show details of construction.

A second embodiment of the present invention is disclosed in FIGS. 3 and 4 of the drawings and is generally identified by the number 110. All similar structure in the second embodiment 110 is identified by the same number in the 100 series.

Second embodiment 110 is chiefly characterized by the fact that the shaft portion 112 and the handle portion 114 are separate pieces joined together in a fashion similar to a fine pool stick. That is, the shaft portion end remote from tip 116 is provided with a threaded socket 124 and the end of handle portion 114 proximate to shaft portion 112 is provided with a threaded pin 126 so that the shaft portion 112 and the handle portion 114 may be threadably joined together in a snug and straight manner. The pin 126 is elongated sufficiently so that one or more washers 128 used as weights may be installed between shaft portion 112 and handle portion 114 to weight the stick in a desirable manner suitable to the percussionist.

The end of handle portion 114 remote from shaft portion 112 is the butt 130 of the handle portion 114 and may be provided with a butt screw 132 adapted to be removeabley fit into a threaded receptacle 134 positioned coaxially within handle portion 114 and adapted to receive and hold ring washer weights 128 if it is desirable that the weight of the stick 110 be at the end thereof remote from tip 116. Thus the stick 110 may be separate sections 112 and 114 and still may be weighted at the butt end 130. Note that the handle portion 114 could be formed from a suitable deformable material such that stick 110 can be articulated should that be desirable for the percussionist.

Thus it can be seen that the present invention accomplishes all of the objects and advantages previously set forth herein for the structure and intended to be covered in the appended claims.

What is claimed is:

1. A percussion implement comprising:

a) an elongated member divided perpendicularly to its longitudinal centerline axis into a co-axial shaft section and an elongated handle section generally oval in planar view;

b) a percussion sound source striking tip disposed at one axial extremity of said member and a butt end of said member at the end thereof remote from said tip with a threaded pin inside said shaft adapted to receive and hold weighted washers for achieving percussionist desired balance for said members.

2. The implement as set forth in claim 1, wherein said elongated member has a separate shaft section and handle section, threadably fixedly joined in axial alignment intermediate said tip and said butt, said threadable joint adapted to hold, if desired, weighted washers to achieve percussionist desired balance of said implement.

3. The implement as set forth in claim 1, wherein said shaft section is provided with a protrusion axially spaced from said tip providing a second striking surface to strike said percussion sound source, said protrusion being of sufficient girth so that a percussionist may use it separately or jointly with said tip as desired.

* * * * *